United States Patent [19]

Schnelle

[11] 3,939,575

[45] Feb. 24, 1976

[54] DRYER UNIT FOR PRINTING PLATES

[75] Inventor: Charles Wayne Schnelle, Aurora, Mo.

[73] Assignee: Tasope' Limited, Aurora, Mo.

[22] Filed: Dec. 4, 1974

[21] Appl. No.: 529,375

[52] U.S. Cl. ..... 34/216; 34/217; 34/233; 34/236

[51] Int. Cl.[2] ..... F26B 19/00

[58] Field of Search ..... 34/1, 4, 150, 60, 203, 34/204, 207, 208, 215, 216, 217, 225, 230, 34/231, 232, 233, 236; 101/354; 219/388, 366–371

[56] References Cited

UNITED STATES PATENTS

| | | | |
|---|---|---|---|
| 2,668,366 | 2/1954 | Barnett | 34/150 |
| 3,134,684 | 5/1964 | Northrop et al. | 34/4 |
| 3,534,393 | 10/1970 | Bickham et al. | 34/225 |
| 3,628,258 | 12/1971 | Schlemmer et al. | 34/150 |
| 3,673,703 | 7/1972 | Wieligmann | 34/225 |
| 3,727,324 | 4/1973 | Melgaard | 34/216 |

*Primary Examiner*—Kenneth W. Sprague
*Assistant Examiner*—James C. Yeung
*Attorney, Agent, or Firm*—Cohn, Powell & Hind

[57] ABSTRACT

This dryer unit includes a housing having an inclined belt conveyor assembly mounted therein for transporting a previously washed printing plate through a drying system. The continuous belt is formed from an open mesh material to facilitate the circulation of drying air through the belt and over and above the plate.

4 Claims, 10 Drawing Figures

DRYER UNIT FOR PRINTING PLATES

BACKGROUND OF THE INVENTION

This invention relates generally to dryer units for printing plates and in particular to a unit having an inclined belt conveyor for passing a previously washed plate through a drying system.

Printing plates which have been treated with an etchant must first be washed and then, in order to expedite the processing, dried and cured. The plates are wet over both the front and rear surfaces following the wash process and in consequence it is necessary to dry both surfaces before stacking ready for use. Obviously, it is an advantage to have the drying process completed as quickly as possible. Unfortunately, although it is a relatively simple matter to subject an exposed front face to a drying process the drying of the rear face is more difficult, unless some sort of holding device is provided to either turn or suspend the plate, because of the problem of exposing both sides of the plate at the same time.

The present dryer overcomes this problem in a manner not disclosed by the known prior art.

SUMMARY OF THE INVENTION

This dryer unit provides a means of rapidly and evenly drying a previously washed printing plate by subjecting both sides of the plate to the drying action of heated air at the same time without removing the plate from the carrying surface.

It is an important object of this invention to provide a dryer housing having a conveyor assembly mounted therewithin for passing the plate through a drying system.

Another object is to provide a conveyor assembly having a transversely inclined conveyor belt of perforate material and to provide means of circulating air through said material.

Yet another object is to provide a drying means which includes a blower having an elongate nozzle disposed to blow heated air across the belt and into an outlet vent which is disposed above the blower and on the opposite side of the belt.

Still another object is to provide a drying means and a curing means to complete polymerization of the plastic workpiece which includes a plurality of ultraviolet lamps disposed in a substantially parallel plane above the inclined upper face of the belt to direct radiation perpendicularly onto said belt.

It is an object to provide a blower having a transverse angle of inclination to the horizontal less than the inclination of the belt.

An important object is to provide a continuous belt formed from opposed chains interconnected by a plurality of transverse rods and wire mesh layers disposed above and below said rods.

It is another object to provide a dryer housing with a continuous flow of hot air to move the heavy moisture laden air from the printing plate and vent it out of the housing as fast as possible.

It is an object to provide a dryer housing including entrance and exit openings, the exit opening being provided with a flapper to permit the belt conveyor to extend outwardly of said opening the flapper facilitating the evacuation of moisture laden air out the vent of the dryer.

An important object is to provide a dryer which is relatively inexpensive to manufacture and extremely efficient and simple to operate.

DESCRIPTION OF THE PREFERRED EMBODIMENT

Figure 2:
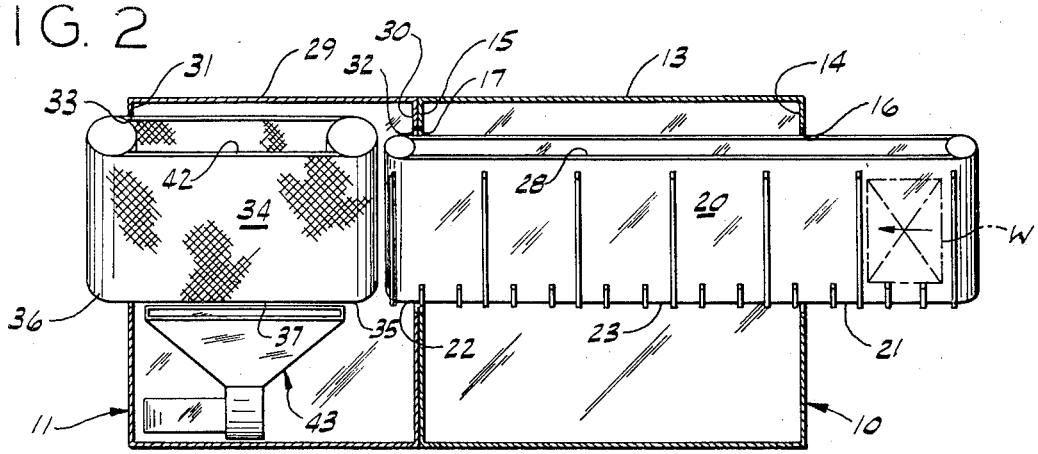
FIG. 2 is a sectional plan view taken on line 2—2 of FIG. 1 with the collector and conveyor assembly side supports omitted for clarity.
Figure 1:
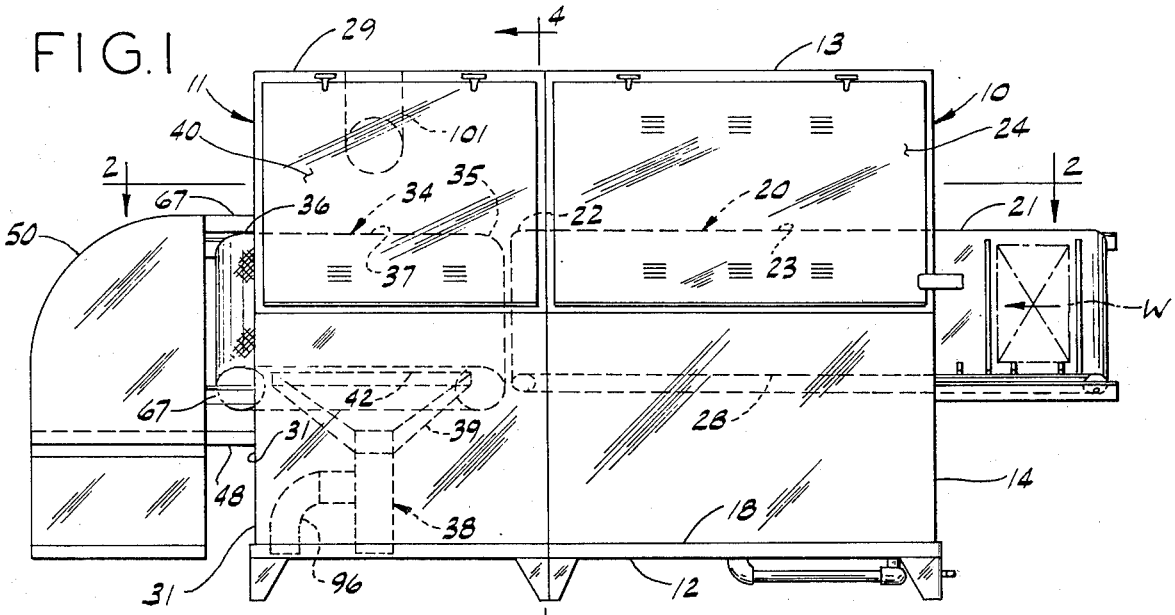
FIG. 1 is a front elevational view of a combination washer and dryer in somewhat schematic form which utilizes the dryer unit.
Figure 5:
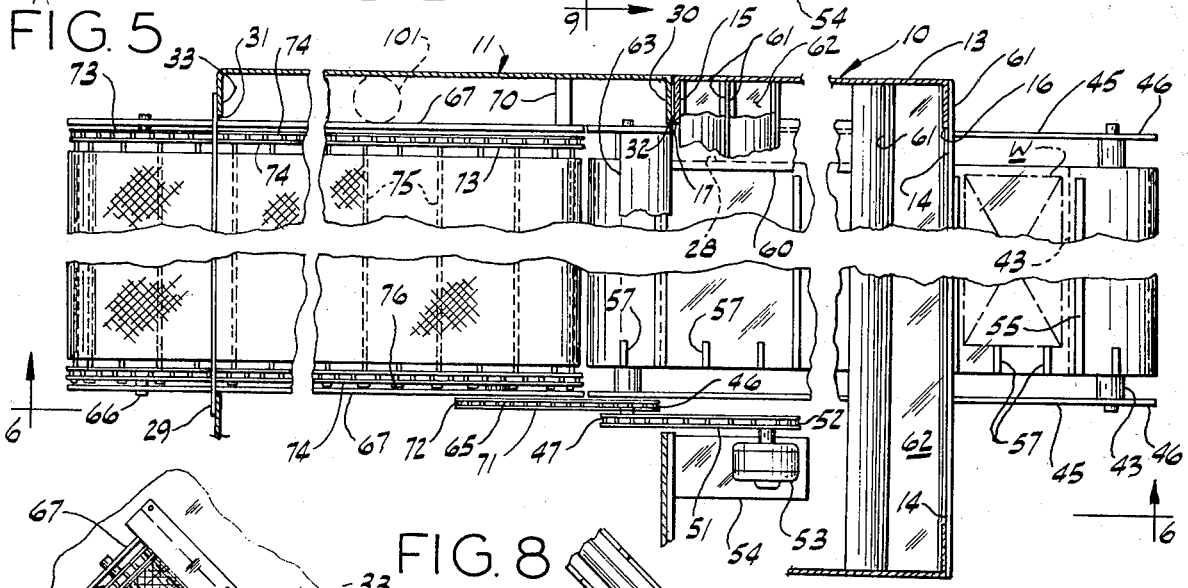
FIG. 5 is an enlarged fragmentary plan view of the washer and dryer conveyor assemblies taken on a plane corresponding to lines 5—5 and 5′—5′ of FIGS. 3 and 4.

Referring now by characters of reference to the drawings and first to FIGS. 1 and 2 it will be understood that the combination washer and dryer includes a washer unit 10 and a dryer unit 11 and that said units are disposed in end-to-end relation and are seated upon a common base 12. Each of the units 10 and 11 includes a belt conveyor assembly, indicated respectively by numerals 20 and 34 which together provide a means of transporting a workpiece W through the washer and dryer combination. The combination unit is particularly adapted to process photosensitive plastic printing plates, which must be first thoroughly washed free of etchant material and then dried and cured to complete polymerization. For simplicity the details of the sealing and mounting of the belt conveyor assemblies are omitted in FIGS. 1 and 2, which are somewhat schematic in form, and will be described below with reference to FIGS. 5 and 6.

As shown in FIG. 2 the washer units 10 includes a housing 13 having opposed end walls 14 and 15 having openings 16 and 17 respectively. The inclined belt conveyor assembly 20 which is housed within the washer housing 13 is inclined at an angle of about 45° in the preferred embodiment and includes opposed end portions 21 and 22 extending outwardly of the housing, through the openings 16 and 17 respectively, and an intermediate portion 23 which extends between said end portions 21 and 22.

Figure 3:
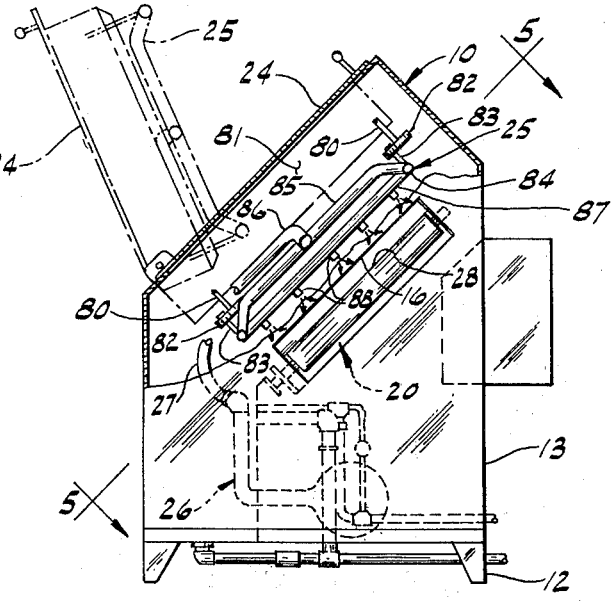
FIG. 3 is an end view of the washer unit with the housing end wall partially removed.

As shown in FIG. 3 the washer housing 13 is provided with a lid 24 having a spray grid assembly 25 eccentrically mounted thereto, said spray grid assembly being connected to a water supply assembly 26 by means of a flexible hose 27. The spray grid assembly 25 provides a moving spray plane substantially parallel to the inclined belt conveyor assembly 20 to direct water onto the upper surface of an inperforate continuous belt 28.

The dryer unit 11 includes a housing 29 having opposed end walls 30 and 31 providing openings 32 and 33 respectively. The belt conveyor assembly 34, which is housed within the dryer housing 29, is inclined at substantially the same angle as the washer unit belt conveyor assembly 20 and includes opposed end portion 35 terminating inwardly of the housing 29; end portion 36 extending outwardly of said housing through the opening 33 and an intermediate portion 37 extending between said end portions 35 and 36. Importantly, the opening 32 in the dryer housing end wall 30 receives the washer conveyor end portion 22 therethrough. This structural arrangement of parts provides that a workpiece W deposited on the right hand conveyor end portion 21 can be passed through the washer and dryer combination and delivered into a collector device 50 provided at the left hand conveyor end portion 36. It will be understood that the belt conveyor assemblies 20 and 34 are aligned to provide upper belt surfaces in substantially the same plane, and that the dryer unit conveyor end portion 35 is sufficiently close to washer unit conveyor end portion 22 so that the workpiece W can readily be transferred from one belt assembly to the other.

Figure 4:
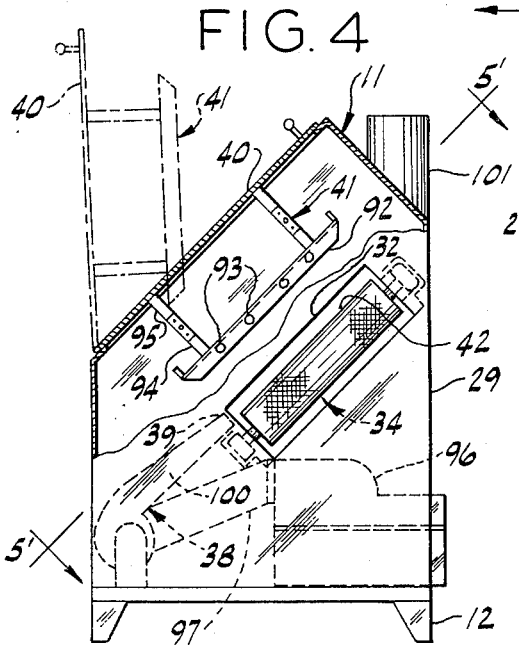
FIG. 4 is an end view of the dryer unit taken on line 3—3 of FIG. 1 with the housing end wall partially removed.

As shown in FIG. 4 the dryer housing 29 includes a lid 40 having an ultraviolet lamp assembly 41 attached thereto in substantially parallel relation to the inclined dryer belt conveyor assembly 34 to direct radiation onto the upper surface of a perforate continuous belt 42. In addition to the ultraviolet lamp assembly 41 the drying of the workpiece W is expedited by means of a blower assembly, generally indicated by numeral 38, which includes a blower 39 directed to supply heated air across the upper portion of said belt 42.

The structural arrangement of the various components of the device, as shown in FIGS. 5–10, will now be described more specifically.

The washer belt conveyor assembly 20 includes a pair of end rolls 43 and 44 carried in journal relation between a pair of opposed, longitudinally disposed side support arms 45 mounted to end walls 14 and 15. End roll 44 provides a drive roll and includes a pair of sprockets 46 and 47 at the lower outer end. Sprocket 46 is connected by means of a chain 51 to a drive sprocket 52 attached to the shaft of a drive motor 53, which is mounted to the washer housing 13 as by a support bracket 54. The washer conveyor belt 28, in the preferred embodiment, is of an imperforate, elastomeric material and includes transverse strips 55 which separate the belt surface into sections each receiving a standard size of workpiece printing plate W. Intermediate, relatively short stop strips 57 are provided which act to retain the workpiece W on the belt 28. The upper edge of the belt 28 is overlapped by a sealing element 60 carried by the longitudinal support 45, which has the effect of precluding the entry of water to the underside of the belt 28.

The washer unit end wall openings 16 and 17 are sealed to preclude the escape of water from the washer housing 13. In the case of opening 16, the seal is provided by a pair of sealing strips 61 attached above the upper margin of the opening 16 by means of a transverse support channel 62. In the free condition the strips hang substantially vertically; however, as clearly shown in FIG. 6, when the washer belt conveyor assembly 20 is installed and operating, the sealing strips 61 provide flaps overlapping the belt 28 to preclude the escape of water from the opening 16, a dead zone being effectively provided between the strips 61. Similar sealing strips 61 are provided for opening 17, in this case a pair of channels 62 being provided for the two strips 61 and, in addition, an exterior strip 63 being provided which acts as a wiper seal and removes excess water from the surface of the belt 28. All of the transverse strips 61 and 63 are attached to their associated channels 62 and housing end walls 14 and 15 as by fasteners.

Figure 6:
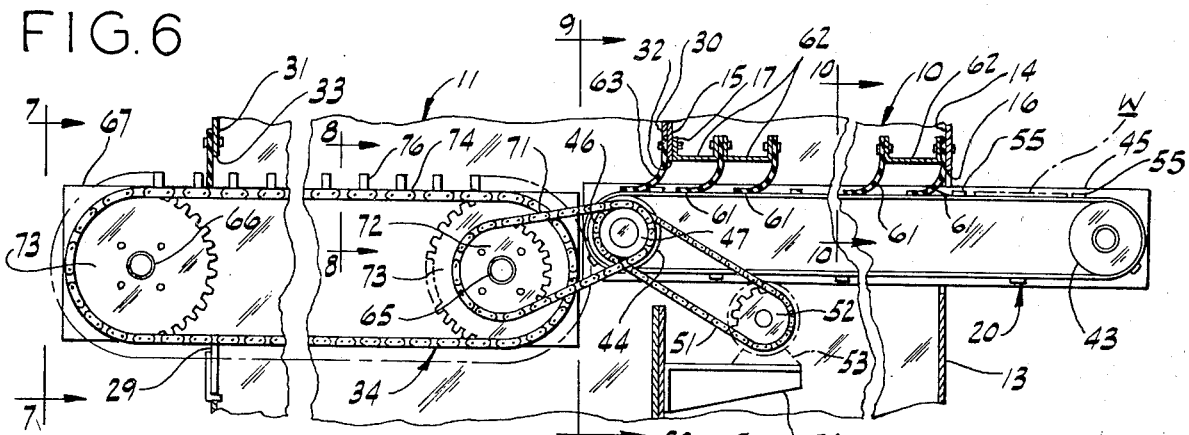
FIG. 6 is a fragmentary sectional elevational view taken on line 6—6 of FIG. 5.

The dryer unit belt conveyor assembly 34, as will be readily understood from FIG. 6, includes a pair of end shafts 65 and 66 carried in journal relation between a pair of longitudinally disposed side support arms 67. In the vicinity of dryer housing end wall opening 33, the side supports 67 are carried by the dryer housing end wall 31. At the other end, said side supports 67 are carried by brackets, such as that indicated typically by numeral 70, attached to the dryer housing 29. As clearly shown in FIG. 6 the drive for the dryer belt conveyor assembly 34 is provided by a chain take-off from the washer belt conveyor assembly 20. The chain, indicated by numeral 71 extends between sprocket 46 of the washer conveyor roller 44 adjacent the dryer conveyor shaft 65 and a sprocket 72 which is provided at the outer end of the shaft 65.

Figure 8:
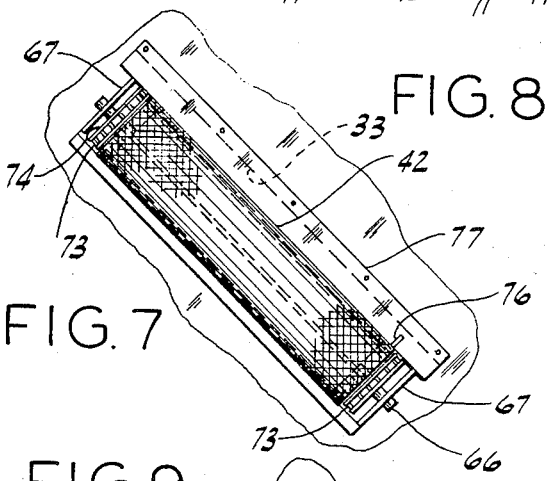
FIG. 8 is an enlarged fragmentary sectional view taken on line 8—8 of FIG. 6.
Figure 7:
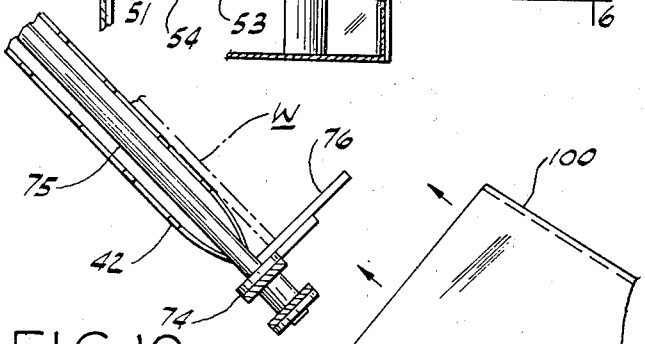
FIG. 7 is a fragmentary sectional view taken on line 7—7 of FIG. 6.
Figure 10:
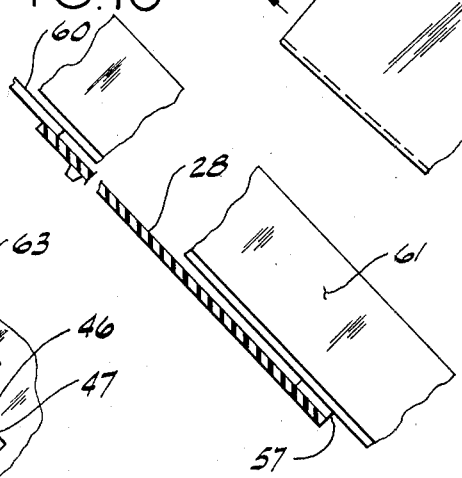
FIG. 10 is an enlarged fragmentary sectional view taken on line 10—10 of FIG. 6.
Figure 9:
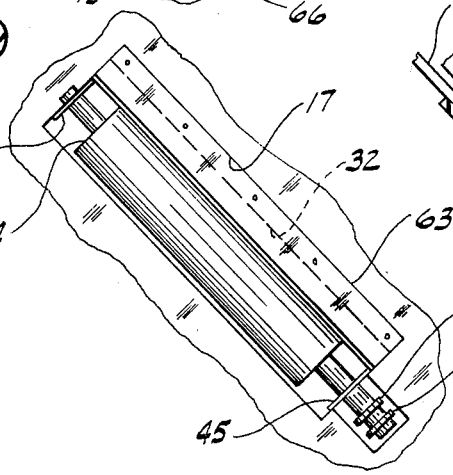
FIG. 9 is a fragmentary sectional view taken on line 9—9 of FIG. 6.

The dryer conveyor shafts 65 and 66 each include a pair of spaced end sprockets 73 interconnected by opposed longitudinally extending chains 74. The two chains 74 are connected at spaced intervals along their length by transverse rods 75 which, in the embodiment shown, extend between and connect every eighth link and provide a mounting means for the perforate belt 42. This belt 42 is of a double thickness, open mesh material as illustrated in FIGS. 7 and 8. At the lower, longitudinal edge of the belt 42, stops 76 are provided, connected to every other link, which act to retain the workpiece W on said mesh belt 42. A flapper element 77 of elastomeric or similar plastic material is provided to seal the dryer unit end wall opening 33 above the mesh belt 42.

The washer unit spray grid assembly 25 is best shown in FIG. 3. It will be understood that this assembly is suspended from four shafts 80 depending from each of four corners of a drive compartment generally indicated by numeral 81. The shafts 80 are connected to a drive means (not shown) within the drive compartment 81 and each includes an eccentric connection 82 at its lower end for mounting an associated pivot shaft 83, said shafts 83 being collectively fixedly attached to the spray grid assembly 25. These eccentric connections cause shafts 83 to orbit about the rotational axes of the shafts 80 to provide a moving spray plane. The spray grid assembly 25 is formed from a generally H-configuration of piping which includes a pair of opposed header arms 84 interconnected by a transverse water supply pipe 85. The supply pipe 85 includes an offset portion 86 which is connected to the water supply assembly 26 by means of the flexible hose 27. The headers 84 are interconnected by a plurality of transverse secondary pipes 87 to each of which is attached a plurality of spray nozzles 88.

The drying and curing system of the dryer unit 11, which is best shown in FIG. 4 consists of two component parts in the preferred embodiment. One of these parts is the ultraviolet lamp assembly 41, which effectuates curing by ultraviolet radiation, and the other is the blower assembly 38 which effectuates drying by hot air.

The ultraviolet lamp assembly 41 includes a rectangular panel 92 mounting a plurality of ultraviolet lamps 93. The panel 92 is provided with two pairs of spaced brackets 94 attached in telescopically adjustable relation to associated brackets 95 depending from the dryer lid 40. The lamps 93 are positioned so that the radiation therefrom is directed onto the workpieces W as said workpieces are moved through the dryer housing 29 by the conveyor belt 42. The blower assembly 38 includes a heater 96 connected by ductwork 97 to the blower 39. The blower 39 provides an elongate nozzle 100 having an orifice extending along a substantial portion of the length of the upper face of the mesh conveyor belt 42. Importantly, as clearly shown in FIGS. 4 and 8, the nozzle 100 directs a stream of heated air which flows across both the front and back of the workpiece W. Heated air tends to rise and in the preferred embodiment the angle of the blower nozzle 100 is slightly less than the angle of inclination of the belt 42 and air is directed up both sides of the workpiece W through the mesh of the belt 42. Moisture saturated air is evacuated through a vent 101 located in the top of the dryer housing above the belt 42 at the far side of said belt.

It is thought that the functional advantages and structural features of this combined washer and dryer have become fully apparent from the foregoing description of parts but from completeness of disclosure the installation and operation of the device will be briefly described.

As shown particularly in FIG. 1 the base 12 is provided with guide rails 18 which facilitate alignment of the washer and dryer units 10 and 11. The washer unit 10 is installed first and the dryer unit 11 is installed by pushing it along the rails 18 until the adjacent washer and dryer housing end walls 15 and 30 respectively are engaged. When the adjacent end walls 15 and 30 of the washer and dryer units 10 and 11 respectively, are engaged, the projecting left hand end portion 22 of the washer belt conveyor assembly 20 is received within the opening 32 of the dryer housing end wall 30. The washer and dryer units 10 and 11 are then connected together as by fasteners (not shown), and collector 50 installed at the left hand end of the dryer unit 11 by attachment to the outstanding portion of the conveyor supports 67, and to an outstanding bracket 48 connected to the dryer end wall 31.

After installation, as clearly shown by FIGS. 1 and 2, the left hand end portion 22 of the washer belt conveyor assembly 20 projecting into the dryer housing is closely adjacent to the right hand end portion 35 of the dryer belt conveyor assembly 34. The receiving end portion 21 of the washer belt conveyor assembly 20 and the discharge end 36 of the dryer belt conveyor assembly 34 project outwardly of their respective housings. Thus, a workpiece W deposited on the right hand end portion 21 of the belt conveyor 20 is passed from one end to the other of the combined unit under continuous movement. As shown in FIG. 6 the upper surfaces of the conveyor belts 26 and 42 are in substantially the same plane. The diameter of the dryer conveyor sprockets 73 is substantially greater than the diameter of the washer conveyor rollers 43 and 44 to provide the comparatively large curvature which is desirable to facilitate movement of the double thickness mesh belt 42 around the sprockets 73. The drive for the dryer belt conveyor assembly 34 is provided by a chain 71 connected between the dryer conveyor sprocket 72 on the shaft 65 and the washer conveyor sprocket 46 on the adjacent washer conveyor roller 44. The sprockets 46 and 72 are sized so that the speeds of the upper surface of the belts 42 and 28 are substantially the same and together with the chain 71 constitute a drive connection means.

It will be understood that when the spray grid assembly 25 is operating a moving bank of spray nozzles, disposed in a plane spaced in parallel relation from the conveyor belt 28, is directed onto said belt. Water is precluded from escaping from the openings 16 and 17 at opposite ends of the washer housing 13 by transverse seals 61 provided interiorly of the housing adjacent each opening. The seals 61 are flexible and are raised slightly by the transverse strips 55 as they pass through the openings 16 and into the washer unit 10. A workpiece W which is retained upon the inclined face of the belt 28 by intermediate stops 57, passes into the washer housing 13 via sealed opening 16 and is subjected to a moving spray from the spray grid assembly 25 as it passes through said housing before exiting from the washer housing via sealed opening 17. As the workpiece W passes into the dryer unit housing 29 via the end opening 32 in the dryer unit end wall 30, the wiper seal 63 removes excess water from the workpiece. Because of the substantial alignment between the conveyor belts 28 and 42 and the relatively close proximity of said belts, the workpiece W is transferred readily from one belt to the other. While progressing through the dryer housing the workpiece W, which is retained on the mesh belt 42 by stops 76, is subjected to perpendicularly directed radiant ultraviolet energy from the lamp assembly 41 which facilitates curing and drying of the workpiece W and to a stream of hot air blown across the upper part of the belt 42 by the relatively narrow, lengthwise elongated orifice of the blower nozzle 100 to flow over both sides of the workpiece W which facilitates drying of said workpiece. The workpiece W then passes out of the dryer housing by way of the opening 33 which is provided with a flapper 77 to substantially facilitate evacuation of moisture laden air from the vent 101 rather than the opening 33.

After passing through the dryer housing 29 the workpiece W is deposited by the belt 42 into the collector 52 in a substantially dry and cured condition, the collector being adapted to retain and stack workpieces until collected.

I claim as my invention:

1. A dryer unit for printing plates comprising:

a. a housing having opposed ends, b. a belt conveyor assembly mounted to the housing and including a continuous movable belt having a perforate flat upper surface inclined in a direction transverse to the direction of motion, the belt carrying a printing plate flat on its upper surface at least part of the distance between opposed housing ends, c. drying means mounted within the housing for circulating air above and below the perforate upper belt surface to dry both faces of the plate, the drying means including a blower having an elongate nozzle orifice disposed adjacent the lower side and substantially in the plane of the perforate flat upper surface of the belt, and disposed to blow heated air upwardly across the flat printing plate and both above and below the perforate flat upper belt surface, and d. the housing including an outlet vent disposed above the nozzle orifice and adjacent the opposite upper side of the perforate flat upper belt surface.

2. A dryer unit as defined in claim 1, in which:

e. the nozzle orifice is disposed to blow the heated air in a path at a transverse angle of inclination to the horizontal less than the inclination of the flat upper belt surface and printing plate thereon, the air passing through the perforate upper belt surface and over the underside of the plate.

3. A dryer unit as defined in claim 1, in which:

e. the continuous belt is of mesh construction to allow heated air to flow therethrough upwardly over the underside of the printing plate carried thereon.

4. A dryer unit as defined in claim 3, in which:

f. the mesh construction of the continuous belt is formed from opposed chains interconnected by a plurality of transverse rods and wire mesh layers disposed above and below said rods.

* * * * *